US012662801B2

(12) United States Patent
Miyazaki et al.

(10) Patent No.: US 12,662,801 B2
(45) Date of Patent: Jun. 23, 2026

(54) WORK MACHINE

(71) Applicant: KOBELCO CONSTRUCTION MACHINERY CO., LTD., Hiroshima (JP)

(72) Inventors: Ryunosuke Miyazaki, Hiroshima (JP); Masaki Akiyama, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 266 days.

(21) Appl. No.: 18/701,864

(22) PCT Filed: Sep. 15, 2022

(86) PCT No.: PCT/JP2022/034603
§ 371 (c)(1),
(2) Date: Nov. 15, 2024

(87) PCT Pub. No.: WO2023/074175
PCT Pub. Date: May 4, 2023

(65) Prior Publication Data

US 2025/0067027 A1 Feb. 27, 2025

(30) Foreign Application Priority Data

Oct. 28, 2021 (JP) ..... 2021-176401

(51) Int. Cl.
*E02F 9/26* (2006.01)
*E02F 3/32* (2006.01)
(Continued)

(52) U.S. Cl.
CPC ..... *E02F 9/265* (2013.01); *E02F 9/2041* (2013.01); *E02F 3/32* (2013.01); *E02F 3/437* (2013.01)

(58) Field of Classification Search
CPC . E02F 9/265; E02F 9/2041; E02F 3/32; E02F 3/437; E02F 9/262; E02F 9/20; E02F 3/43; E02F 9/26
See application file for complete search history.

(56) References Cited

U.S. PATENT DOCUMENTS 6,085,583 A 7/2000 Cannon et al.
2011/0106308 A1* 5/2011 Eliasson ..... B25J 9/1664 700/250
(Continued)

FOREIGN PATENT DOCUMENTS

EP 3 748 087 A2 12/2020
JP 11-158933 A 6/1999
(Continued)

OTHER PUBLICATIONS

Extended European Search Report issued on Feb. 5, 2025 in European Application No. 22886509.3, 6 pages.
(Continued)

*Primary Examiner* — Rodney A Butler
(74) *Attorney, Agent, or Firm* — Oblon, McClelland, Maier & Neustadt, L.L.P.

(57) ABSTRACT

Provided is a work machine operated automatically with reduced discomfort. The work machine includes a controller which sets target trajectory information including target points on a target path of a control target part and an inter-target-point time and makes an upper turning body and a work device perform a target motion of moving the control target part in accordance with the target path information. When judging work including the target motion to reach a predetermined stage, the controller shifts at least one of the start point and the terminal point of the next target motion and corrects the inter-target-point time based on the change from a previous movement amount to a new movement amount. The previous movement amount is the movement
(Continued)

amount of the control target part from the start point to the terminal point before the shift, and the new movement amount is that after the shift.

7 Claims, 7 Drawing Sheets

(51) Int. Cl.
*E02F 3/43* (2006.01)
*E02F 9/20* (2006.01)

(56) References Cited

U.S. PATENT DOCUMENTS

| | | | |
|---|---|---|---|
| 2019/0218747 | A1 | 7/2019 | Hashimoto |
| 2021/0318688 | A1 | 10/2021 | Yoshimoto et al. |

FOREIGN PATENT DOCUMENTS

| | | | |
|---|---|---|---|
| JP | 2001-123479 | A | 5/2001 |
| JP | 2016-113791 | A | 6/2016 |
| WO | WO 2018/179383 | A1 | 10/2018 |
| WO | WO 2020/049809 | A1 | 3/2020 |
| WO | WO 2020/158779 | A1 | 8/2020 |
| WO | WO 2021/060534 | A1 | 4/2021 |

OTHER PUBLICATIONS

International Search Report mailed Oct. 25, 2022 in PCT/JP2022/034603 filed on Sep. 15, 2022, 2 pages.

* cited by examiner

WORK MACHINE

TECHNICAL FIELD

The present invention relates to a work machine capable of being automatically operated.

BACKGROUND ART

Patent Literature 1 discloses an automatically operated excavator to automatically perform work motions from excavation of earth and sand to removal thereof. Specifically, Patent Literature 1 discloses automatically moving (shifting) the next excavation position in the turning direction of an upper turning body when the excavation depth reaches a set value at a certain excavation position.

The shift of the excavation position, however, may greatly change the speed of the movement of each of the upper turning body and the attachment from the excavation position to the removal position to thereby cause an operator to feel discomfort. For example, an occurrence of steep motion of the upper turning body and the attachment may cause an operator around the automatically operated excavator to feel anxiety.

CITATION LIST

Patent Literature

Patent Literature 1: Japanese Unexamined Patent Publication No. 2001-123479

SUMMARY OF INVENTION

It is an object of the present invention to provide a work machine capable of being automatically operated with reduced discomfort that an operator feels.

Provided is a work machine including a lower travel body, an upper turning body, a work device, and a controller. The upper turning body is mounted on the lower traveling body capably of turning. The work device is attached to the upper turning body rotatably to perform a work motion. The controller sets target trajectory information and controls driving of the upper turning body and the work device so as to make the upper turning body and the attachment perform a target motion of moving the control target part in accordance with the target trajectory information. The target trajectory information is a plurality of target points on a target path of the control target part included in the work device, and a target value of a time in which the control target part moves between adjacent target points among the plurality of target points. The controller is configured to shift at least one of a start point and a terminal point of the plurality of target points of the next target motion and correct the target trajectory information when judging that work including the target motion has reached a predetermined stage. The correction of the target trajectory information contains a correction of the inter-target-point time based on a change from a previous movement amount to a new movement amount. The previous movement amount is an amount by which the control target part moves from the start point to the terminal point before the shift of the at least one of the start point and the terminal point, and the new movement amount is an amount by which the control target part moves from the start point to the terminal point after the shift of the at least one of the start point and the terminal point.

DETAILED DESCRIPTION

A preferred embodiment of the present invention will now be described with reference to the drawings.

Configuration of a Work Machine

Figure 1:
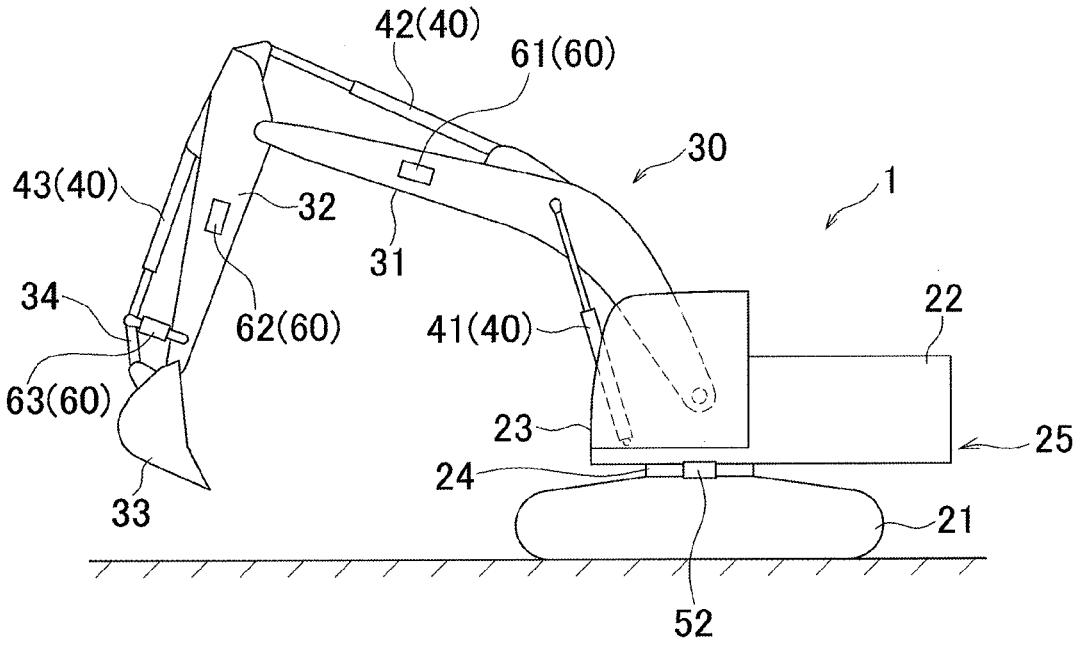
FIG. 1 is a side view of a work machine according to an embodiment of the present invention.

FIG. 1 shows a work machine 1 according to an embodiment of the present invention. The work machine 1 is capable of being automatically operated. The work machine 1 is a hydraulic excavator, which includes a machine body 25 including a lower traveling body 21 and an upper turning body 22, a turning device 24, an attachment 30, and a work driving device 40.

The lower traveling body 21 includes a pair of crawler, which is actuated to thereby enable the lower traveling body 21 to perform a traveling motion. The upper turning body 22 is mounted on the lower traveling body 21 capably of performing a turning motion of turning with respect to the lower traveling body 21. The turning device 24 is a turning driving device that causes the upper turning body 22 to perform the turning motion. The upper turning body 22 includes a cab (operation room) 23 which forms a front part of the upper turning body 22.

The attachment 30 is a work device attached to the upper turning body 22 capably of performing a work motion. The work motion includes a vertically rotational movement. The attachment 30 includes a boom 31, an arm 32, and a bucket 33. The boom 31 has a proximal end and a distal end opposite thereto, the proximal end being connected to the upper turning body 22 capably of vertically rotational movement (capably of being raised and lowered). The arm 32 has a proximal end and a distal end opposite thereto, the proximal end being connected to the distal end of the boom 31 capably of vertically rotational movement. The bucket 33 is a tip attachment, which is attached to the distal end of the arm 32 capably of rotational movement in a front-rear direction to form the tip of the attachment 30. The bucket 33 has a shape capable of performing work operation such as excavation, leveling, scooping, and the like, on an excavation object including earth and sand. The excavation object by the bucket 33 is not limited to earth and sand but allowed to be also a stone or a waste (industrial waste, etc.). Besides, the work machine according to the present invention is not limited to an excavation machine and, therefore, the work object is not limited to the excavation object. For example, the tip attachment to form the tip of the work apparatus according to the present invention is not limited to the bucket 33 for holding earth and sand as described above but allowed to be also a grapple for gripping a work object, a lifting magnet for attracting a work object to hold it, or the like.

The work driving device 40 is capable of making the attachment 30 perform the work motion by hydraulic actuation of the attachment 30. The work driving device 40 includes a plurality of hydraulic cylinders, each of which is capable of performing expansion and contraction motions, the plurality of hydraulic cylinders including a boom cylinder 41, an arm cylinder 42, and a bucket cylinder 43.

The boom cylinder 41 is arranged so as to actuate the boom 31 vertically rotationally in rising and falling directions (vertical direction) with respect to the upper turning body 22 by performing the expansion and contraction motions. The boom cylinder 41 has a proximal end to be rotatably connected to the upper turning body 22 and a distal end to be rotatably connected to the boom 31.

The arm cylinder 42 is arranged so as to actuate the arm 32 vertically rotationally with respect to the boom 31 by performing the expansion and contraction motions. The arm cylinder 42 has a proximal end to be rotationally connected to the boom 31 and a distal end to be rotationally connected to the arm 32.

The bucket cylinder 43 is arranged so as to actuate the bucket 33 rotationally with respect to the arm 32 by performing the expansion and contraction motions. The bucket cylinder 43 has a proximal end to be rotationally connected to the arm 32 and a distal end to be rotationally connected to a link member 34. The link member 34 is rotationally connected to the bucket 33 to interconnect the bucket cylinder 43 and the bucket 33.

The work machine 1 further includes a turning angle sensor 52, which is a turning angle detector, and a working posture detector 60.

The turning angle sensor 52 detects a turning angle of the upper turning body 22 with respect to the lower traveling body 21. The turning angle sensor 52 is, for example, an encoder, a resolver, or a gyro sensor. In the present embodiment, the turning angle of the upper turning body 22 at which the frontward direction of the upper turning body 22 coincides with the frontward direction of the lower traveling body 21 is fixed to 0°.

The working posture detector 60 detects a working posture, which is the posture of the attachment 30 as the work device, including a boom inclination sensor 61, an arm inclination sensor 62, and a bucket inclination sensor 63 in the present embodiment.

The boom inclination sensor 61 is attached to the boom 31 to detect the posture of the boom 31. The boom inclination sensor 61 is, specifically, a sensor that acquires the inclination angle of the boom 31 to a horizontal line, for example, an inclination (acceleration) sensor. The working posture detector 60 may include, instead of the boom inclination sensor 61, a rotation angle sensor that detects a rotation angle of the boom 31 around a boom foot pin, which is a support shaft of the proximal end of the boom 31, or a stroke sensor that detects a stroke of the boom cylinder 41.

The arm inclination sensor 62 is attached to the arm 32 to detect the posture of the arm 32. The arm inclination sensor 62 is, specifically, a sensor that acquires the inclination angle of the arm 32 to a horizontal line, for example, an inclination (acceleration) sensor. The working posture detector 60 may include, instead of the arm inclination sensor 62, a rotation angle sensor that detects a rotation angle of the arm 32 around an arm connection pin that is a support shaft of the proximal end of the arm 32, or a stroke sensor that detects a stroke of the arm cylinder 42.

The bucket inclination sensor 63 is attached to the link member 34 to detect the posture of the bucket 33. The bucket inclination sensor 63 is, specifically, a sensor that acquires the inclination angle of the bucket 33 to a horizontal line, for example, an inclination (acceleration) sensor. The working posture detector 60 may include, instead of the bucket inclination sensor 63, a rotation angle sensor that detects a rotation angle of the bucket 33 around a bucket connection pin which is a support shaft of the proximal end of the bucket 33, or a stroke sensor that detects a stroke of the bucket cylinder 43. The following description is made about the case of excavating earth and sand using the bucket 33.

Figure 2:
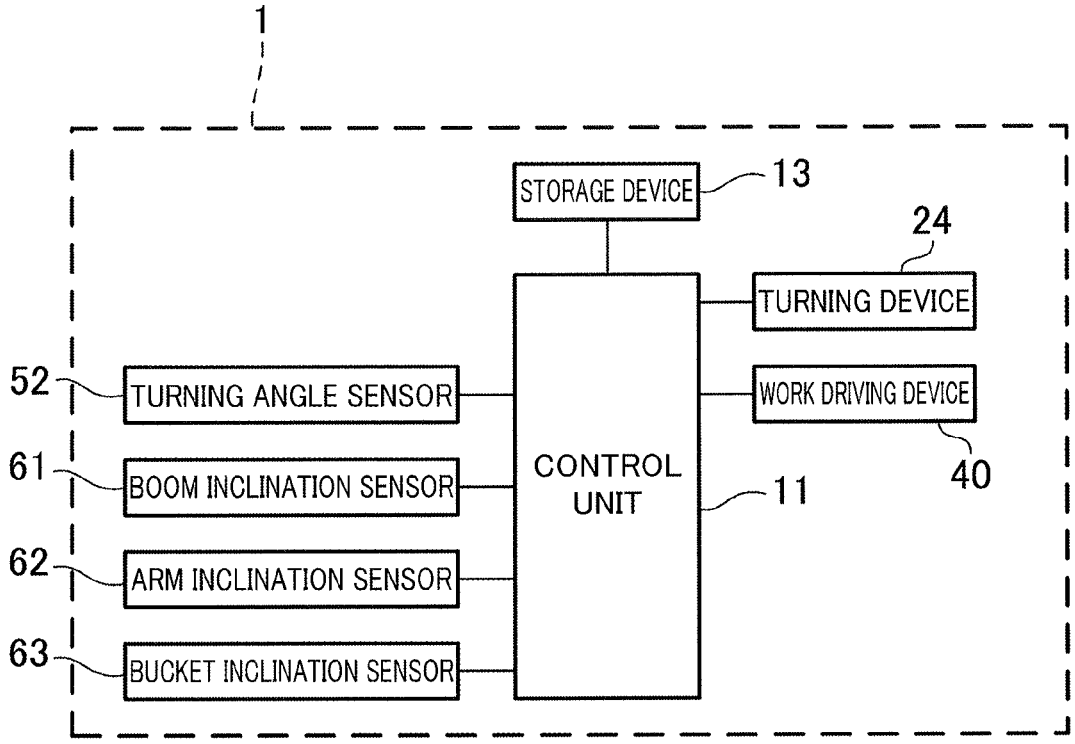
FIG. 2 is a block diagram showing a controller unit installed on the work machine and elements connected thereto.

As shown in FIG. 2, the work machine 1 includes a control unit 11 and a storage device 13.

To the control unit 11 is input information detected by the turning angle sensor 52, that is, information about the turning angle (turning posture) of the upper turning body 22 with respect to the lower traveling body 21. To the control unit 11 is input working posture information, which is information about the posture detected by the working posture detector 60, that is, the posture of the attachment 30 as the work device. The working posture information contains: information detected by the boom inclination sensor 61, that is, information on the posture of the boom 31; information detected by the arm inclination sensor 62, that is, information on the posture of the arm 32; and information detected by the bucket inclination sensor 63, that is, information on the posture of the bucket 33.

The control unit 11 according to the present embodiment serves as a setting means of setting target trajectory information. The target trajectory information contains a plurality of target points and an inter-target-point movement time. The plurality of target points are set on a target path of a control target part in the attachment 30, which is, in the present embodiment, the tip of the bucket 33. The inter-target-point movement time is a target value of a time in which the tip of the bucket 33 should be moved between adjacent target points among the plurality of target points, namely, a target inter-target-point movement time.

The control unit 11 automatically controls the work machine 1. The control unit 11 controls the driving of the upper turning body 22 and the attachment 30 so as to make the upper turning body 22 and the attachment 30 perform a series of motions. The work machine 1 is, thus, automatically operated. Specifically, the control unit 11 automatically controls the driving of the upper turning body 22 by the turning device 24 and the driving of the attachment 30 by the work driving device 40, based on the information detected by the turning angle sensor 52 and the working posture detector 60. In the present embodiment, the series of motions are motions for excavating earth and sand and discharging it. The series of motions, therefore, includes an excavation motion for excavating earth and sand by the bucket 33.

The control unit 11 controls the driving of the upper turning body 22 and the attachment 30 so as to make the upper turning body 22 and the attachment 30 perform a target motion of moving the tip of the bucket 33 in accordance with the target trajectory information. The target motion is included in the series of motions. The series of motions include an excavation motion, a lifting and turning motion, an earth removal motion, and a return turning motion, each of which motions is capable of corresponding to the target motion. The lifting and turning motion, the earth removal motion, and the return turning motion are described later.

Figure 3:
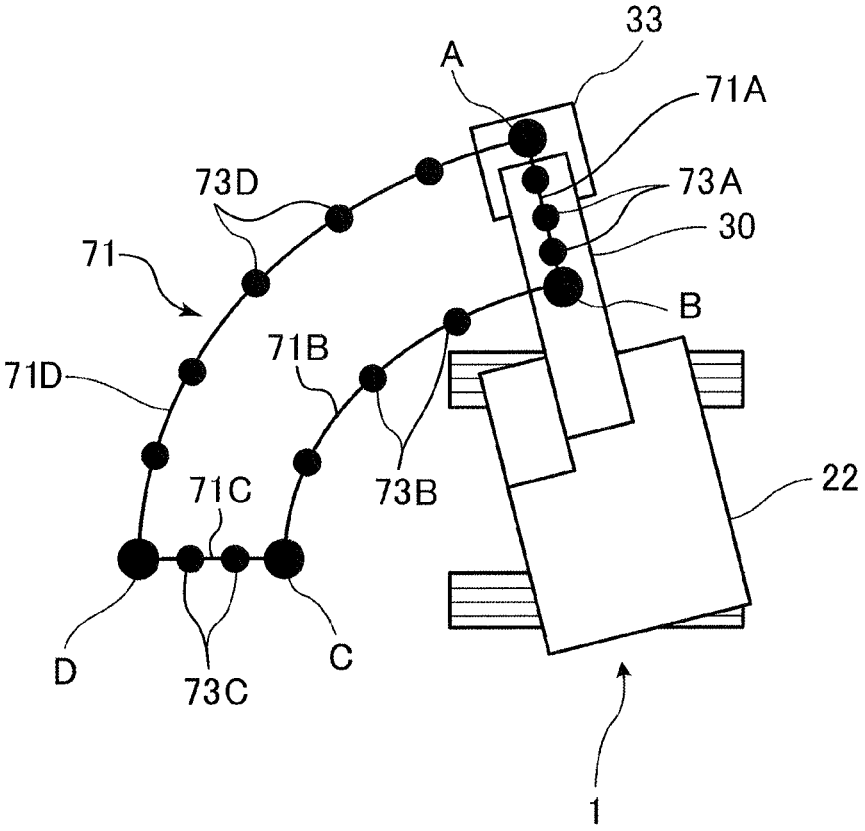
FIG. 3 is a plan view showing a target path of the tip of a bucket in a lifting and turning motion of the work machine.

FIG. 3 shows a target path 71 of the tip of the bucket 33 in the series of motions. The excavation motion involves the movement of the tip of the bucket 33 from a point A to a point B. The lifting and turning motion involves the turn of the tip of the bucket 33 from the point B to the point C. The lifting and turning motion is performed with earth and sand held in the bucket 33. The earth removal motion involves the movement of the tip of the bucket 33 from the point C to the point D and the rotation of the bucket 33 in the opening direction during the movement, and the rotation of the bucket 33 causes the earth and sand to be discharged to a vessel of a dump truck or the like. The return turning motion involves the turn of the tip of the bucket 33 in a return direction from the point D to the point A. The control target part according to the present invention is not limited to the tip of the bucket 33.

As shown in FIG. 3, the plurality of target points are set on the target path 71 of the tip of the bucket 33. As to a lifting and turning path 71B that corresponds to the lifting and turning motion from the point B to the point C in the target path 71, in addition to the point B and the point C which are the start point and the terminal point, respectively, a plurality of intermediate target points 73B are set between the points B and C. Similarly, as to an excavation path 71A from the point A which is the start point of the excavation motion to the point B which is the terminal point of the motion in the target path 71, in addition to the points A and B, a plurality of intermediate target points 73A are set between the points A and B. Similarly, as to an earth removal path 71C from the point C which is the start point of the earth removal motion to the point D which is the terminal point of the motion in the target path 71, in addition to the point C and the point D, a plurality of intermediate target points 73C are set between the point C and the point D. Similarly, as to a return turning path 71D from the point D which is the start point of the return turning motion to the point A which is the terminal point of the motion, a plurality of intermediate target points 73D are set in addition to the point D and the point A.

Figure 4:
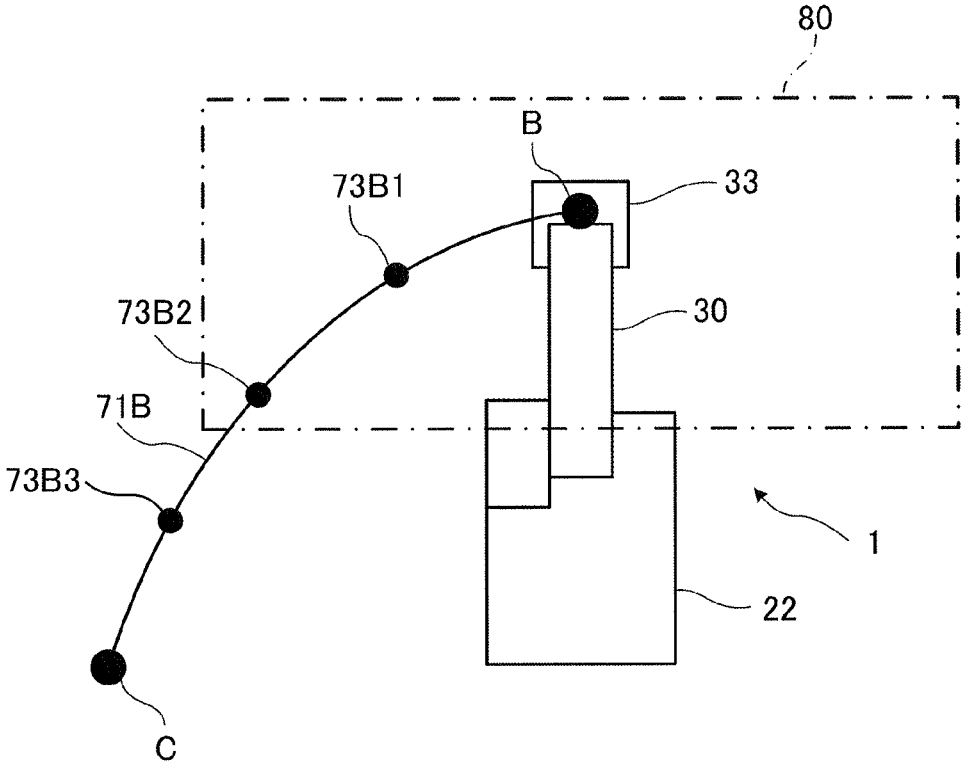
FIG. 4 is a plan view showing a target path and a target point of the tip of the bucket before the shift of a point included in the target path.

FIG. 4 shows details of the lifting and turning path 71B from the point B to the point C. In the lifting and turning path 71B, the tip of the bucket 33 moves through each of a section from the point B which is the start point to a first intermediate target point 73B1 which is the first intermediate target point, a section from the first intermediate target point 73B1 to a second intermediate target point 73B2 which is the second intermediate target point, a section from the second intermediate target point 73B2 to a third intermediate target point 73B3 which is the third intermediate target point, and a section from the third intermediate target point 73B3 to the point C which is the terminal point, in an inter-target-point time that is predetermined for each of the sections. The same applies to the excavation path 71A from the point A to the point B, the earth removal path 71C from the point C to the point D, and the return turning path 71D from the point D to the point A.

The control unit 11 shown in FIG. 2 serves as a repetition means of making the upper turning body 22 and the attachment 30 repeat the series of motions. The control unit 11, specifically, makes the series of motions repeated with a change of the height of the tip of the bucket 33 during the excavation motion. The series of motions from excavation of earth and sand to earth removal are, thus, repeated at the same excavation place with the change of the depth of excavation of earth and sand.

The storage device 13 constitutes a controller in association with the control unit 11, storing the series of motions. The series of motions is set by, for example, teaching by an operator. In the series of motions, the control target part of the attachment 30, that is, the tip of the attachment 30 or the tip of the bucket 33 in the present embodiment, moves along the target path 71.

The control unit 11 serves as a depth limit setting means of setting a depth limit. The depth limit is a limit value that is set for an excavation depth, which is the depth by which earth and sand is excavated by the bucket 33. As described above, the series of motions from excavation of earth and sand to earth removal are repeated with the change of the excavation depth.

The control unit 11 judges that the work performed by the repetition of the series of motions has reached a predetermined stage at the time when the excavation depth in the excavation motion reaches the depth limit. When judging that the work by the repetition of the series of motions has reached the predetermined stage, the control unit 11 terminates the repetition of the series of motions at the same excavation place.

It is also desirable that the control unit 11 or the storage device 13 stores a target number of repetitions that is the number of times by which the series of motions should be repeated and the control unit 11 is configured to judge that the work by the repetition of the series of motions has reached a predetermined stage at the time when the number of times the series of motions are repeated reaches the target number of repetitions.

At the time of judging that the work by the repetition of the series of motions has reached the predetermined stage, the control unit 11 shifts the start point of the excavation motion from the point A shown in FIG. 3 to the start point of the excavation motion in the next series of motions. This shift is made in the turning direction of the upper turning body 22. The shift from the point A to a next new start point in the turning direction of the upper turning body 22 involves a shift from the point B to a next new terminal point. That is because the excavation motion is performed without turn of the upper turning body 22. The shift of the start point allows the series of motions to be repeated at a new excavation place.

As described above, in the lifting and turning path 71B shown in FIG. 4 in the present embodiment, the drive of the upper turning body 22 and the attachment 30 is controlled so as to make the tip of the bucket move through each of the section from the point B that is the start point of the lifting and turning motion to the first intermediate target point 73B1, the section from the first intermediate target point 73B1 to the next second intermediate target point 73B2, the section from the second intermediate target point 73B2 to the next third intermediate target point 73B3, and the section from the third intermediate target point 73B3 to the point C that is the terminal point, in one second.

Figure 5:
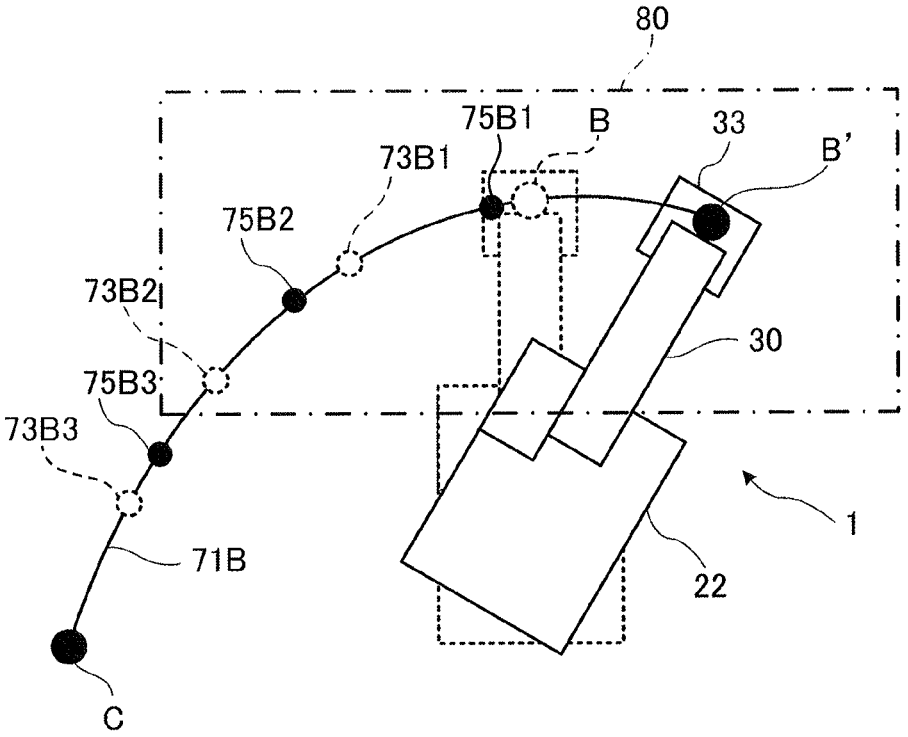
FIG. 5 is a plan view showing an example of a target path and a target point of the tip of the bucket after the shift of the point.

FIG. 5 shows an example of the shifts of the plurality of target points for the lifting and turning path 71B. In the example shown in FIG. 5, the start point is shifted from the point B shown in FIG. 4 to a point B'. The shift is made in a direction that is the turning direction of the upper turning body 22 and also a path expanding direction, by 30°, the path expanding direction being a direction in which the start point is separated from the point C which is the terminal point. The control unit 11, in place of the first to third intermediate target points 73B1, 73B2, 73B3 before the shift, newly sets a new first intermediate target point 75B1, a second intermediate target point 75B2, and a third intermediate target point 75B3 corresponding thereto, on the target path of the tip of the bucket 33 between the point B' which is the shifted start point and the point C, that is, revised lifting and turning path 71B. In summary, the first to third intermediate target points 73B1 to 73B3 are shifted to the first to third intermediate target points 75B1 to 75B3, respectively. The control unit 11 controls the turning motion of the upper turning body 22 so as to make the tip of the bucket 33 move in the interval between adjacent target points among the new target points B', 75B1 to 75B3 and C in respective inter-target-point times. In FIG. 5, the new first to third intermediate target points 75B1 to 7353 after the shift are indicated by respective black dots, and the first to third intermediate target points 73B1 to 73B3 before the shift are shown in respective white dots. Among the plurality of shifted target points, namely, the point B' which is the start point, the first to third intermediate target points 75B1 to 75B3, and the point C which is the terminal point, the distance between adjacent target points is greater than the distance between the plurality of target points before the shift.

If the inter-target-point time set for each interval between adjacent target points among the plurality of thus shifted target points is equal to the inter-target-point time before the shift (e.g., one second), the tip of the bucket 33 is required to move between adjacent target points of the plurality of shifted target points at a higher speed than that before the shift. This may render the movement of the upper turning body 22 and the attachment 30 steep to cause an operator around the work machine 1 to feel anxiety.

To prevent it, the control unit 11 serves as a correction means of correcting the target trajectory information. Specifically, the control unit 11 corrects the inter-target-point time, based on a change from the previous movement amount to the new movement amount, so as to restrain the speed of the bucket 33 from being varied with the change. The previous movement amount is the amount by which the control target part of the attachment 30, that is, the tip of the bucket 33 in the present embodiment, moves from the point B which is the start point before the shift to the point C which is the terminal point, and the new movement amount is the amount by which the control target part moves from the point B' which is the shifted start point to the point C.

More specifically, the control unit 11 serves as a calculation means of calculating the ratio of the previous movement amount and the new movement amount. The control unit 11 according to the present embodiment calculates a turning angle difference ratio $\alpha$. The turning angle difference ratio $\alpha$ is the ratio of a post-change turning angle difference $\Delta\theta 2$ to a pre-change turning angle difference $\Delta\theta 1$ ($\alpha=\Delta\theta 2/\Delta\theta 1$), wherein the pre-change turning angle difference $\Delta\theta 1$ is the difference between respective turning angles of the upper turning body 22 corresponding to the point B that is the start point before the shift and the point C that is the terminal point, and the post-change turning angle difference $\Delta\theta 2$ is the difference between respective turning angles of the upper turning body 22 corresponding to the point B' which is the start point after the shift and the point C which is the terminal point. For example, when the turning angle of the upper turning body 22 corresponding to the point B that is the start point before the shift is 0°, the turning angle of the upper turning body 22 corresponding to the point C that is the terminal point is −80°, and the turning angle of the upper turning body 22 corresponding to the point B' that is the start point after the shift is 30°, the turning angle difference ratio $\alpha$ is equal to $(80°+30°)/(80°+0°)=1.375$.

The control unit 11 corrects the inter-target-point time based on the thus calculated turning angle difference ratio $\alpha$. Specifically, with the shift of the start point from the point B to the point B', the control unit 11 makes correction of replacing the inter-target-point time before the shift of the start point, namely, one second, with 1.375 seconds.

The control unit 11 controls the driving of the upper turning body 22 and the attachment 30 so as to make the tip of the bucket 33 move between adjacent target points among a plurality of newly set target points B', 75B1, 75B2, 75B3 and C in the corrected inter-target-point time, namely, 1.375 seconds, thereby being able to operate the upper turning body 22 and the attachment 30 so as to cause an operator to have the same speed feeling as before the shift of the start point, that is, make the lifting and turning motion after the shift to be made. This restrains the movement of the upper turning body 22 or the attachment 30 from being rendered steep by the shift of the start point, thereby restraining an operator around the work machine 1 from feeling anxiety.

Figure 6:
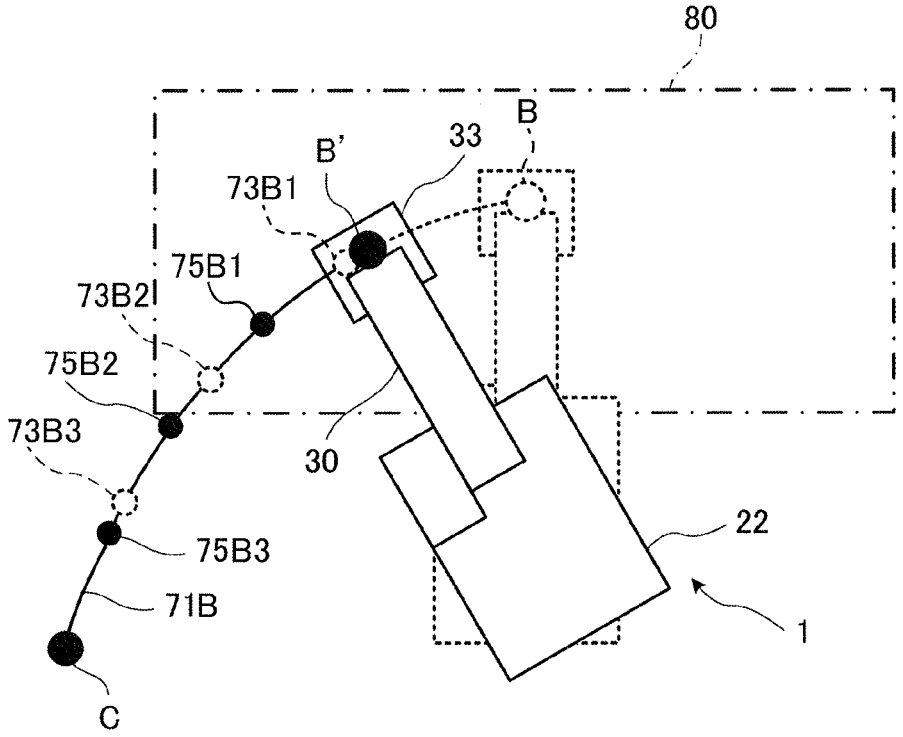
FIG. 6 is a plan view of another example of a target path and a target point for the tip of the bucket after the shift of the point.

FIG. 6 shows another example of the lifting and turning path 71B after the shift of the start point from the point B to the point B' and the first to third intermediate target points 75B1 to 75B3 after the shift. In the example shown in FIG. 6, the point B shown in FIG. 4 is shifted to the point B' by 30° in the turning direction of the upper turning body 22 toward a point C. The control unit 11 sets, in place of the previously set target points 73B1, 73B2, 73B3, a new first intermediate target point 75B1, a second intermediate target point 75B2, and a third intermediate target point 75B3 on the target path of the tip of the bucket 33 between the point B' that is the shifted start point and the point C that is the terminal point, namely, the lifting and turning path 71B. In FIG. 6, the newly set first to third intermediate target points 75B1 to 75B3 are indicated by respective black dots, and the previously set first to third intermediate target points 73B1 to 73B3 are indicated by respective white dots. The distance between the adjacent target points among the plurality of newly set target points B', 75B1 to 75B3 and C is smaller than the distance between the adjacent target points among the plurality of previously set target points B. 73B1 to 73B3, C.

If the inter-target-point distance is kept one second regardless of the shift from the point B to the point B', that is, if a control is performed to make the tip of the bucket 33 move in one second through each of the section from the point B' to the first intermediate target point 75B1, the section from the first intermediate target point 75B1 to the second intermediate target point 75B2, the section from the second intermediate target point 75B2 to the third intermediate target point 75B3, and the section from the third intermediate target point 75B3 to the point C, the reduction in the distance between the adjacent target points with the shift reduces the speed of the movement of the tip of the bucket 33. This case prevents the movement of the upper turning body 22 and the attachment 30 from becoming steep, thereby generating little possibility of causing an operator around the work machine 1 to feel anxiety; however, the reduction in the speed of the movement of the tip of the bucket 33 causes the worker to feel discomfort and lowers work efficiency.

To prevent it, also in the example shown in FIG. 6, the control unit 11 serves as a correction means of correcting the inter-target-point time, based on a change from the previous movement amount to the new movement amount, so as to restrain the speed of the motion of the bucket 33 from being varied with the change. Specifically, the control unit 11 calculates a ratio of the previous movement amount and the new movement amount, more specifically, calculates the turning angle difference ratio $\alpha$ similarly to the example shown in FIG. 5. For example, when the turning angle of the upper turning body 22 corresponding to the point B, which is the start point before the shift, is 0°, the turning angle of the upper turning body 22 corresponding to the point C that is the terminal point is −80°, and the turning angle of the upper turning body 22 corresponding to the point B', which is the shifted start point, is −30°, the turning angle difference ratio α is equal to (80° to 30°)/(80° to 0°)=0.625.

The control unit 11 corrects the inter-target-point time based on the thus calculated turning angle difference ratio α. Specifically, along with the shift, the control unit 11 make correction of replacing the inter-target-point time before the shift of the start point, namely, one second, with 0.625 seconds.

The control unit 11 controls the driving of the upper turning body 22 and the attachment 30 so as to make the tip of the bucket 33 move in 0.625 seconds in each of the intervals between adjacent target points among the plurality of newly set target points B', 75B1, 75B2, 75B3, C, thereby being able to operate the upper turning body 22 and the attachment 30 so as to cause an operator to have the same speed feeling as before the shift of the point B.

Although the present embodiment is described about the change of the lifting and turning motion, the same applies to the case of change of any of the excavation motion, the earth removal motion, and the return turning motion.

The control unit 11 serves as an area setting means of setting an allowable area 80 as shown in FIGS. 4 to 6. The allowable area 80 is set for the area within which work should be performed by the attachment 30. The control unit 11 makes the shift of the target point, e.g., the setting of the shifted start point, within the preset allowable area 80. This can prevent the attachment 30 from being deviated from the allowable area 80 by the change of the target motion, preventing the attachment 30 from being brought into interference with obstacles or the like outside the allowable area 80 by the target motion.

Also, the control unit 11 serves as an upper limit speed setting means of setting a target upper limit speed for the speed of the tip of the bucket 33, which is the control target part of the attachment 30, and is configured to correct the inter-target-point time so as to make the tip of the bucket 33 of the attachment 30 move at a speed equal to or less than the target upper limit speed. Too short inter-target-point time after the correction may render the speed at which the tip of the bucket 33 moves too high to cause an operator around the work machine 1 to feel anxiety. The correction of the inter-target-point time for operating the attachment 30 at a speed equal to or less than the target upper limit speed can suitably restrain an operator around the work machine 1 from feeling anxiety.

Modification

In place of the shift of the start point of the lifting and turning motion (the shift from the point B to the point B'), the point C as the terminal point may be shifted to another point. Alternatively, both the start point and the terminal point of the lifting and turning motion may be shifted. The shift of the point C, which is not only the terminal point of the lifting and turning motion but also the start point of the earth removal motion, causes the series of motions to be repeated at a new place for earth removal.

The shift of at least one of the points A to D is not limited to the shift in the turning direction of the upper turning body 22 as shown in FIGS. 4 to 6. The shift may be made in a direction in which the posture of the attachment 30 is changed or in the traveling direction of the lower traveling body 21.

The correction of the inter-target-point time is not limited to one based on the ratio of the new movement amount to the previous movement amount. The correction of the inter-target-point time may be performed, for example, by use of a prepared map correlating the movement amount of the attachment 30 and the inter-target-point time with each other.

The work machine according to the present invention is not limited to the work machine 1 with the bucket 33 for excavating earth and sand as described above. The present invention can be applied, for example, to also a work machine with another tip attachment, such as a lifting magnet, in place of the bucket 33. In such a work machine, the target motion allows to be included therein a pick-up motion, which is a motion of holding an object (attracting the object by magnetic force in the case of the lifting magnet) and lifting the object. The work machine can make the upper turning body and the work device perform a series of motions including the pick-up motion, for example, a motion of picking up an object such as iron waste with the lifting magnet and a motion of removing the thus held object to a vessel of a dump truck or the like. In this case, preferably, the controller is configured to make the work device repeat the motions for the work with a change of the height of a tip attachment attached to the tip of the work device instead of the bucket 33, for example, the lifting magnet (with the rise and fall of the lifting magnet).

The controller provided for a work machine with the lifting magnet or another tip attachment having holding function is preferably configured to set a height limit. The height limit is a limit value that is set for the height of the tip attachment in a pick-up motion of holding and picking up an object. The controller judges that a repeated work has reached a predetermined stage, when the height of the tip attachment reaches the height limit, and shifts the start point of the pick-up motion.

Figure 7:
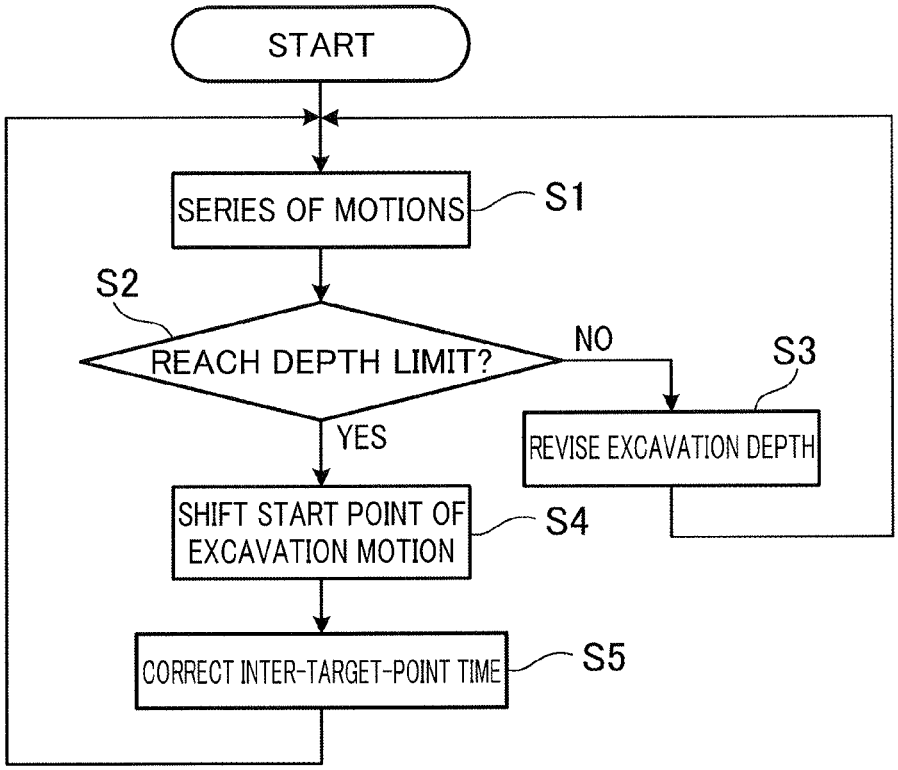
FIG. 7 is a flowchart showing a process performed by the controller.

FIG. 7 is a flowchart showing a process performed by the control unit 11 to control the motions shown in FIGS. 4 to 6.

The control unit 11, initially, makes the upper turning body 22 and the attachment 30 perform the series of motions (step S1). In this series of motions, the control unit 11 judges whether or not the depth during excavation has reached the depth limit (Step S2).

In the series of motions, when judging the depth during the excavation not to reach the depth limit (NO in step S2), the control unit 11 revises the excavation depth (step S3), and then repeats the series of motions (step S1). The series of motions are, thus, repeated with the change of the height of the tip of the bucket 33 during the excavation motion.

At the time when judging that the depth during excavation has reached the depth limit (YES in step S2), the control unit 11 shifts the start point (point A) of the excavation motion included in the series of motions, in the turning direction of the upper turning body 22 (step S4). The shift involves the shift of the start point of the lifting and turning motion from the point B to the point B'.

Next, as to the lifting and turning motion, the control unit 11 corrects the time to be required for the tip of the bucket 33 to move through each of the section from the point B' which is the shifted start point to the first intermediate target point 75B1, the section from the first intermediate target point 75B1 to the second intermediate target point 75B2, the section from the second intermediate target point 75B2 to the third intermediate target point 75B3 and the section from the third intermediate target point 75B3 to the point C which is the terminal point, namely, the inter-target-point time (Step S5). Preferably, the correction of the inter-target-point time is made to make the attachment 30 move at a speed equal to or less than the target upper limit speed. Following the correction of the inter-target-point time, the series of motions are repeated at a new excavation place (step S1).

While embodiments of the present invention have been described above, specific examples are illustrative only and, in particular, without limiting the invention, specific configurations and the like can be appropriately designed. Also, the effects and effects described in the embodiments of the invention have only enumerated the most preferred effects and effects arising from the present invention, and the effects and advantages of the present invention are not limited to those described in embodiments of the invention.

Provided is a work machine including a lower travel body, an upper turning body, a work device, and a controller. The upper turning body is mounted on the lower traveling body capably of turning. The work device is rotatably attached to the upper turning body capably of performing a work motion. The controller sets target trajectory information and controls driving of the upper turning body and the work device so as to make the upper turning body and the attachment perform a target motion of moving the control target part in accordance with the target trajectory information. The target trajectory information is a plurality of target points on a target path of the control target part included in the work device, and a target value of a time in which the control target part moves between adjacent target points among the plurality of target points. The controller is configured to shift at least one of a start point and a terminal point of the plurality of target points of the next target motion and correct the target trajectory information when judging that work including the target motion has reached a predetermined stage. The correction of the target trajectory information includes a correction of the inter-target-point time based on a change from a previous movement amount to a new movement amount. The previous movement amount is an amount by which the control target part moves from the start point to the terminal point before the shift of the at least one of the start point and the terminal point, and the new movement amount is an amount by which the control target part moves from the start point to the terminal point after the shift of the at least one of the start point and the terminal point.

The controller, which corrects the inter-target-point time based on a change of the current movement amount from the previous movement amount of the control target part, specifically, makes the correction to restrain the speed of the movement of the control target part from being varied with the change from the previous movement amount to the new movement amount, can operate the upper turning body and the work device with a reduced variation in speed feeling from that before the shift of at least one of the start point and the terminal point of the target motion, regardless of the shift. This can restrain the speed of the movement of the upper turning body and the work device from being suddenly varied to thereby reduce discomfort (e.g., anxiety due to a steep movement) that would be imparted to an operator around the work machine.

It is preferable that the controller, for example, is configured to calculate a ratio of the previous movement amount and the new movement amount and to correct the inter-target-point time based on the ratio.

Preferably, the controller is configured to make a shift at least one of the start point and the terminal point within an allowable area that is set for an area in which work is performed by the work device. This can prevent the work device from being deviated from the allowable area by the shift, thereby preventing the work device from being brought into interference with obstacles lying outside the allowable area, regardless of the shift.

Preferably, the controller is configured to correct the inter-target-point time so as to make the control target part move at a speed equal to or less than a target upper limit speed that is set for a speed of the control target part of the work device. This can restrain an operator around the work machine 1 from being caused to feel anxiety by the excessive speed of the movement of the control target part between adjacent target points due to the too short inter-target-point time after the correction.

It is preferable that the controller is configured to make the upper turning body and the work device repeat a series of motions including the target motion, the series of motions including an excavation motion for excavating earth and sand with the work device, configured to make the series of motions repeated with a change of a height of a tip of the work device in the excavation motion, and configured to shift a start point of the excavation motion in the next series of motions when an excavation depth by which the earth and sand are excavated reaches a depth limit that is a limit value that is set for the excavation depth. This allows the excavation motion to be continued with the change of an excavation place.

Alternatively, it is also preferable that the series of motions includes a pick-up motion for holding and picking up an object by the work device, and the controller is configured to make the upper turning body and the work device repeat the series of motions with a change of a height of a tip of the attachment in the pick-up motion and configured to shift a start point of the pick-up motion in the next series of motions when the height of the work device in the pick-up motion reaches a height limit that is a limit value set for the height. This allows the pick up of the object to be continued with the change of the position at which the object is picked up.

Preferably, the controller stores a target repetition number, which is the number of times to make the upper turning body and the work device repeat a series of motions including the target motion and is configured to shift at least one of the start point and the terminal point in the next series of motions when the series of motions are repeated by the target repetition number. The storage of the target number of repetitions for the series of motions allows the timing of the transition to the next series of motions to be easily determined.

The invention claimed is:

1. A work machine comprising:

a lower traveling body;

an upper turning body mounted on the lower traveling body capably of turning;

a work device rotatably attached to the upper turning body capably of performing a work motion, the work device including a control target part; and a controller that sets target trajectory information and controls driving of the upper turning body and the work device so as to make the upper turning body and the work device perform a target motion of moving the control target part in accordance with the target trajectory information, the target trajectory information containing a plurality of target points on a target path of the control target part included in the work device and an inter-target-point time that is a target value of a time in which the control target part moves between adjacent target points among the plurality of target points, wherein:

the controller is configured to make a shift of at least one of a start point and a terminal point of the plurality of target points of the next target motion and make a correction of the target trajectory information when judging that work including the target motion has reached a predetermined stage; and the correction of the target trajectory information includes a correction of the inter-target-point time based on a change from a previous movement amount to a new movement amount, the previous movement amount being an amount by which the control target part moves from the start point to the terminal point before the shift of the at least one of the start point and the terminal point, and the new movement amount being an amount by which the control target part moves from the start point to the terminal point after the shift of the at least one of the start point and the terminal point.

2. The work machine according to claim 1, wherein the controller is configured to calculate a ratio of the new movement amount to the previous movement amount and to correct the inter-target-point time based on the ratio.

3. The work machine according to claim 1, wherein the controller is configured to make the shift at least one of the start point and the terminal point within an allowable area that is set for an area in which work is performed by the work device.

4. The work machine according to claim 1, wherein the controller is configured to correct the inter-target-point time so as to make the control target part move at a speed equal to or less than a target upper limit speed that is set for a speed of the control target part of the work device.

5. The work machine according to claim 1, wherein: the controller is configured to make the upper turning body and the work device repeat a series of motions including the target motion, the series of motions including an excavation motion for excavating earth and sand with the work device; the controller is configured to make the series of motions repeated with a change of a height of a tip of the work device in the excavation motion; and the controller is configured to shift a start point of the excavation motion in the next series of motions when an excavation depth by which the earth and sand are excavated reaches a depth limit that is a limit value that is set for the excavation depth.

6. The work machine according to claim 1, wherein: the controller is configured to make the upper turning body and the work device repeat a series of motions including the target motion, the series of motions including a pick-up motion for holding and picking up an object by the work device; the controller is configured to make the upper turning body and the work device repeat the series of motions with a change of a height of a tip of the attachment in the pick-up motion; and the controller is configured to shift a start point of the pick-up motion in the next series of motions when a height of the work device in the pick-up motion reaches a height limit that is a limit value that is set for the height.

7. The work machine according to claim 1, wherein the controller stores a target repetition number, which is the number of times by which the upper turning body and the work device should be made repeat a series of motions including the target motion and the controller is configured to shift at least one of the start point and the terminal point in the next series of motions when the series of motions are repeated by the target repetition number.

* * * * *